US009292785B1

(12) United States Patent
Davis et al.

(10) Patent No.: US 9,292,785 B1
(45) Date of Patent: Mar. 22, 2016

(54) GOAL TRACKING SYSTEM

(71) Applicants: Kelley L. Davis, North Platte, NE (US); Jason S. Davis, North Platte, NE (US)

(72) Inventors: Kelley L. Davis, North Platte, NE (US); Jason S. Davis, North Platte, NE (US)

( * ) Notice: Subject to any disclaimer, the term of this patent is extended or adjusted under 35 U.S.C. 154(b) by 132 days.

(21) Appl. No.: 14/014,688

(22) Filed: Aug. 30, 2013

Related U.S. Application Data

(62) Division of application No. 12/974,372, filed on Dec. 21, 2010, now abandoned.

(60) Provisional application No. 61/288,512, filed on Dec. 21, 2009.

(51) Int. Cl.

| | |
|---|---|
| ***G06M 1/00*** | (2006.01) |
| ***G06M 1/22*** | (2006.01) |
| ***A44C 5/00*** | (2006.01) |

(52) U.S. Cl.
CPC ..... *G06M 1/22* (2013.01); *A44C 5/0053* (2013.01)

(58) Field of Classification Search
None
See application file for complete search history.

(56) References Cited

U.S. PATENT DOCUMENTS

| | | | | |
|---|---|---|---|---|
| 7,313,929 | B2 | 1/2008 | Lazor | |
| 7,331,707 | B2 | 2/2008 | DelValle et al. | |
| 2008/0060110 | A1 | 3/2008 | Schmelzer et al. | |
| 2009/0265971 | A1* | 10/2009 | Cook | 40/633 |
| 2011/0061424 | A1* | 3/2011 | Gupta | 63/1.13 |

* cited by examiner

*Primary Examiner* — Jack W Lavinder
(74) *Attorney, Agent, or Firm* — Advent, LLP

(57) ABSTRACT

A goal tracking system is described. The goal tracking system can include a bracelet having numeric indicia disposed thereon representing an accomplishment or a goal such as weight loss. A button connector is adjacent to each of the numeric indicia to maintain a button-charm. The button-charm is moved from numeric indicia to numeric indicia as a corresponding goal is achieved. In one aspect, the bracelet may be used to track weight loss results, set weight loss goals, promote improved eating habits, and serve as a reminder to stay focused and motivated towards reaching weight loss goals.

17 Claims, 2 Drawing Sheets

GOAL TRACKING SYSTEM

RELATED APPLICATIONS

The present application is a divisional of U.S. patent application Ser. No. 12/974,372, filed Dec. 21, 2010, titled "GOAL TRACKING SYSTEM," which claims the benefit under 35 U.S.C. §119(e) of U.S. Provisional Application Ser. No. 61/288,512, filed Dec. 21, 2009, and titled "BRACELET." U.S. patent application Ser. No. 12/974,372 and U.S. Provisional Application Ser. No. 61/288,512 are herein incorporated by reference in their entireties.

BACKGROUND

Determination and motivation are needed to reach and maintain healthy eating habits. However, existing mechanisms for tracking goals such as weight loss are not easily accessible. Consequently, persons attempting weight loss may become distracted and lose focus on reaching their weight loss goal.

SUMMARY

A goal tracking system is described. The goal tracking system can include a bracelet having numeric indicia disposed thereon representing an accomplishment or a goal such as weight loss. A button connector is adjacent to each of the numeric indicia to maintain a button-charm. The button-charm is moved from numeric indicia to numeric indicia as a corresponding goal is achieved. In one aspect, the bracelet may be used to track weight loss results, set weight loss goals, promote improved eating habits, and serve as a reminder to stay focused and motivated towards reaching weight loss goals.

BRIEF DESCRIPTION OF THE DRAWINGS

The detailed description is described with reference to the accompanying figures. In the figures, the use of the same reference numbers in different instances in the description and the figures may indicate similar or identical items.

DETAILED DESCRIPTION

Figure 1:
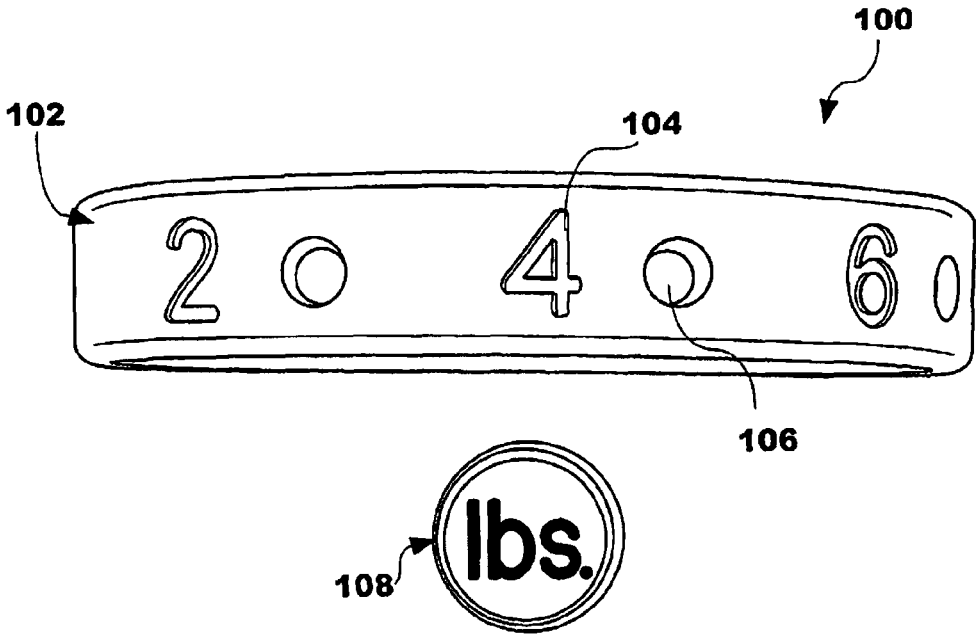
FIG. 1 is an illustration showing a bracelet in accordance with an example implementation.
Figure 2:
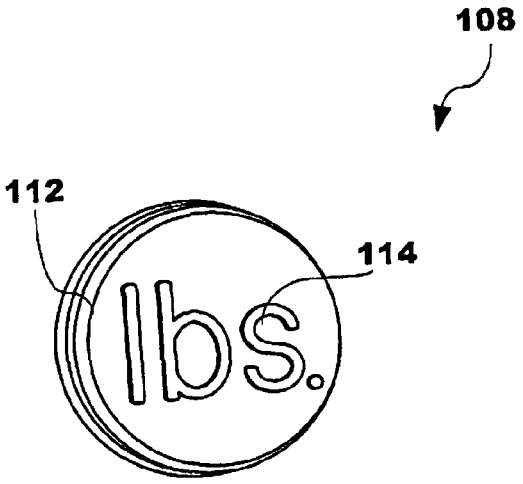
FIGS. 2 and 3 are illustrations showing the button-charm of the bracelet shown in FIG. 1 in greater detail.
Figure 3:
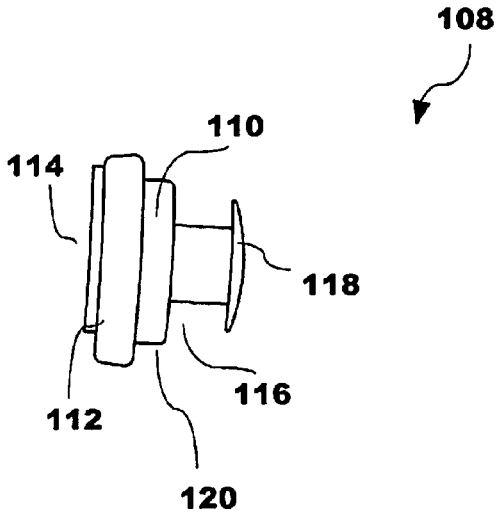
Figure 4:
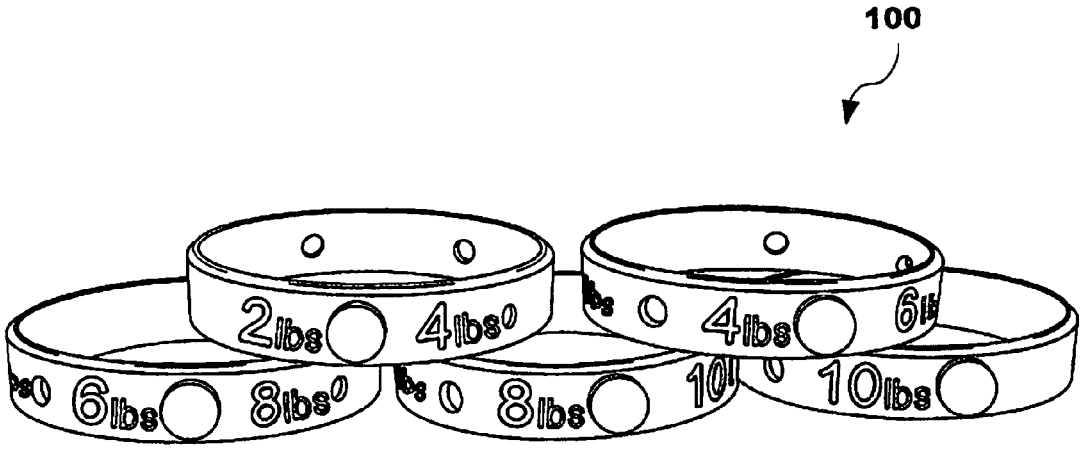
FIG. 4 is an illustration showing example bracelets having different arrangements of numbers.

FIGS. 1 through 4 illustrate an example bracelet 100 configured for tracking goals such as weight loss. The bracelet 100 allows its user to set a weight loss goal in a numerical, visible fashion, and provides a way for the user to track the weight loss results. The bracelet 100 is visible on the user's wrist and thus serves to keep the user focused on reaching weight loss goals. Thus, the bracelet 100 may help motivate the user towards proper eating habits and discourage bad eating habits.

As shown, the bracelet 100 can include a flexible band 102 having numeric indicia 104 disposed thereon that are suitable for representing an accomplishment or a goal such as weight loss. A button connector 106 can be, for example, a hole or slit formed through the flexible band 102 adjacent to each of the numeric indicia 104 to receive a button-charm 108 inserted therethrough. Even though button connector 106 is described herein as a hole or slit, button connector 106 can also include a snap, connector, a magnetic connector, a velcro connector, and the like. The button-charm 108 is moved from numeric indicia 104 (e.g., button connector 106) to numeric indicia 104 (e.g., button connector 106) as a corresponding amount of weight is lost. In this manner, the bracelet 100 may be used to track weight loss results, set weight loss goals, promote improved eating habits, and serve as a reminder to a user to stay focused and motivated towards reaching weight loss goals.

The band 102 may be formed in a continuous loop, e.g., without a latching mechanism. However, it is contemplated that the band may be equipped with a latching mechanism such as a buckle or button (not shown). In various embodiments, the band 102 may be provided in a single size selected to fit an average human wrist, or may be provided in two or more sizes to accommodate users having different sized wrists (e.g., small, medium, large, extra large, etc.).

The band 102 is fabricated of a suitable material which may be flexible. Example materials include rubber (e.g., a synthetic silicone rubber, a natural rubber, etc.), leather, a plastic, vinyl, a polyethylene fiber material, or a metal (e.g., aluminum, steel, gold, silver, platinum, etc.), or the like. In the embodiment illustrated, the band 102 is approximately ½ inch in width and ⅛ inch in thickness. However, it is contemplated that the band 102 could be narrower or wider and/or thicker or thinner. The band 102 can be fabricated in any color or combination of colors.

Numeric indicia 104 may be formed on the band 102 using a variety of techniques. For example, numeric indicia 104 may be formed during molding of the band 102, by embossed or debossed printing on the band 102, by stamping, by painting, and so on. In the embodiments illustrated, the numeric indicia 104 are shown arranged on the band 102 in groups of five. However, the numeric indicia 104 may be arranged in sets of more or less numbers (e.g., sets of four numbers or sets of six numbers, and so on). Moreover, the numeric indicia 104 are shown arranged to increase in a reading fashion from left to right. However, the numeric indicia 104 may also be arranged to decrease from left to right. Numeric indicia 104 can be provided in any increment and may have any value. Examples include: "1 2 3 4 5" "2 4 6 8 10" "10 20 30 40 50" "1.5 3 4.5 6 7.5 9" "½ 1 1½ 2 2½ 3". However, other examples are possible.

Button connectors 106 may be formed in the band 102 on the right side of, and horizontal to, each numeric indicia 104. The button connectors 106 can extend through the band 102 and are illustrated as being circular in shape, but could be any shape such as a triangular, rectangular, square, and so forth.

The button-charm 108 is comprised of a button portion 110 that can be connected to one of the button connectors 106 formed in the band 102 and a charm portion 112 that may be provided with metric indicia 114 on its face. The button 110 and the charm 112 may be fabricated as separate components that are attached together using a suitable fastener such as glue, rubber cement, adhesive, a mechanical attachment, and so on. However, it is contemplated that the button-charm 108 may also be fabricated as a single (e.g., one-piece) component.

The button portion 110, which may be fabricated of a generally rigid material such as plastic, a metal, and so on, is comprised of a cylinder portion 116 having a flange 118, 120 on each end. In embodiments, the cylinder portion 116 may be approximately 3/16 inch in diameter and ⅛ inch in length. In such embodiments, the bottom flange 118 may be approximately 5/16 inch in diameter, while the top flange may be ⅜ inch in diameter. However, the size and dimensions of the button portion 110 may be smaller or larger.

In the embodiment illustrated, the charm portion 112 is provided with metric indicia 114 that provide a context to numeric indicia 104. For example, metric indicia 114 can comprise the letter "lbs." However, it is contemplated that metric indicia 114 may comprise any design, symbol, lettering (e.g., "Kg"), or numbering. Metric indicia 114 may be formed on the charm portion 112 using a variety of techniques. For example, metric indicia 114 may be formed during molding of the charm portion 112, by embossed or debossed printing on the charm portion 112, by stamping, by painting, and so on. The charm portion 112 is fabricated of a suitable material, such as rubber (e.g., a synthetic silicone rubber, a natural rubber, etc.), leather, a plastic, vinyl, a polyethylene fiber material, or a metal (e.g., aluminum, steel, gold, silver, platinum, etc.), or the like. In the embodiment illustrated, the charm is ½ inch in diameter. However, it is contemplated that the charm portion 112 could be larger or smaller. Moreover, the charm portion 112 is shown as circular in shape, but may be any shape, color or combination of colors.

The bracelet 100 is initially worn with the button-charm 108 removed. The bracelet 100 is configured to assist the user in tracking weight loss results by allowing the user to place the button-charm 108 in the button connector 106 adjacent to the numeric indicia 104 corresponding to the amount of weight (e.g., number of pounds) lost during a user's weight loss attempt. For example, an example bracelet 100 may have a band 102 including the numbers "1 2 3 4 5" and a button-charm 108 containing the indicia "lbs." The user places the "lbs." button-charm 108 into the button connector 106 of the band 102 next to the numeric indicia 104 that represents the number of pounds that the user has lost. Thus, when the user has lost one pound, the user connects the "lbs." button-charm 108 to the button connector next to the number "1" of the numeric indicia 104. Next, the user moves the "lbs." button-charm 108 to the next numeric indicia 104 as weight loss increases. Thus, when the user loses another pound, so that the user has a total weight loss of two pounds, the user connects the "lbs." button-charm 108 to the button connector 106 next to the number "2" of the numeric indicia 104.

In this manner, the bracelet 100 provides motivation by inducing a desire in the user to reach the next higher number during a weight-loss attempt. The bracelet 100 also functions as a mental reward by providing satisfaction when the user can move the button to the next higher numeric indicia 104. Moreover, the bracelet 100 furnishes a visual reminder of the progress achieved as well as the results desired. The bracelet 100 further reminds the user that he or she desires to lose weight. For example, the bracelet 100 is worn on the wrist of the user's hand to serve as a visual reminder/warning to the user to help prevent the impulsive snacking (e.g., the user views the bracelet 100 when reaching for an unhealthy snack such as candy or junk food).

Although the subject matter has been described in language specific to structural features and/or methodological acts, it is to be understood that the subject matter is not necessarily limited to the specific features or acts described above. Rather, the specific features and acts described above are disclosed as examples.

What is claimed is:

1. A method for tracking weight loss comprising:

placing a bracelet on a wrist of a user, the bracelet comprising a plurality of consecutive groupings extending around the bracelet, respective groupings including a goal signifying a level of weight loss and a hole extending through the continuous flexible bracelet adjacent to the goal;

attaching a button charm having a button portion to the bracelet by inserting the button portion through the hole of a first grouping, the first grouping including a first weight loss amount goal; and advancing the button charm by removing the button portion from the hole of the first grouping and inserting the button portion through a hole of a second grouping, the second grouping including a second weight loss amount goal;

wherein the weight loss amount goals of respective groupings are consecutively incremented with respect to the level of weight loss signified so that advancement of the button charm is configured to incentivize the user to attain a level of weight loss signified by at least the next incremental goal.

2. The method as recited in claim 1, wherein the weight loss amount goals comprise one or more intermediate goals and a final goal, and wherein the first weight loss amount goal comprises an intermediate goal, and the second weight loss amount goal comprises one of a second intermediate goal or the final goal.

3. The method as recited in claim 1, wherein the bracelet comprises a continuous flexible band.

4. The method as recited in claim 1, wherein the respective weight loss amount goals comprise numeric indicia.

5. The method as recited in claim 1, wherein the button portion of the button charm comprises a cylindrical portion and a flange on an end of the cylindrical portion.

6. The method as recited in claim 1, wherein the button charm further comprises a charm portion coupled to the button portion.

7. A method for tracking weight loss comprising:

attaching a button charm having a button portion to a bracelet configured to be worn on a wrist of a user, the bracelet comprising a plurality of consecutive groupings extending around the bracelet, respective groupings including a goal signifying a level of weight loss and a hole extending through the continuous flexible bracelet adjacent to the goal, the button charm being attached by inserting the button portion through the hole of a first grouping, the first grouping including a first weight loss amount goal; and advancing the button charm by removing the button portion from the hole of the first grouping and inserting the button portion through a hole of a second grouping, the second grouping including a second weight loss amount goal;

wherein the weight loss amount goals of respective groupings are consecutively incremented with respect to the level of weight loss signified so that advancement of the button charm is configured to incentivize the user to attain a level of weight loss signified by at least the next incremental goal.

8. The method as recited in claim 7, wherein the weight loss amount goals comprise one or more intermediate goals and a final goal, and wherein the first weight loss amount goal comprises an intermediate goal, and the second weight loss amount goal comprises one of a second intermediate goal or the final goal.

9. The method as recited in claim 7, wherein the bracelet comprises a continuous flexible band.

10. The method as recited in claim 7, wherein the respective weight loss amount goals comprise numeric indicia.

11. The method as recited in claim 7, wherein the button charm further comprises a charm portion coupled to the button portion.

12. A method for tracking weight loss comprising:

receiving a bracelet on a wrist of a user, the bracelet comprising a plurality of consecutive groupings extending around the bracelet, respective groupings including a goal signifying a level of weight loss and a hole extending through the continuous flexible bracelet adjacent to the goal;

attaching a button charm having a button portion to the bracelet by inserting the button portion through the hole of a first grouping, the first grouping including a first weight loss amount goal; and thereafter advancing the button charm by removing the button portion from the hole of the first grouping and inserting the button portion through a hole of a second grouping, the second grouping including a second weight loss amount goal;

again advancing the button charm by removing the button portion from the hole of the second grouping and inserting the button portion through a hole of a third grouping, the third grouping including a third weight loss amount goal;

wherein the weight loss amount goals of respective groupings are consecutively incremented with respect to the level of weight loss signified so that advancement of the button charm is configured to incentivize the user to attain a level of weight loss amount signified by at least the next incremental goal.

13. The method as recited in claim 12, wherein the weight loss amount goals comprise an initial goal, one or more intermediate goals, and a final goal, and wherein the first weight loss amount goal comprises the initial goal, the second weight loss amount goal comprises an intermediate goal, and the third weight loss amount goal comprises one of a second intermediate goal or the final goal.

14. The method as recited in claim 12, wherein the bracelet comprises a continuous flexible band.

15. The method as recited in claim 12, wherein the respective weight loss amount goals comprise numeric indicia indicative of the goal.

16. The method as recited in claim 12, wherein the button portion of the button charm comprises a cylindrical portion and a flange on an end of the cylindrical portion.

17. The method as recited in claim 12, wherein the button charm further comprises a charm portion coupled to the button portion.

* * * * *